United States Patent [19]

Yoshinaga et al.

[11] 4,421,457

[45] Dec. 20, 1983

[54] DIFFUSER OF CENTRIFUGAL FLUID MACHINE

[75] Inventors: Yoichi Yoshinaga, Minorimachi; Hiromi Kobayashi, Shimoinayoshi; Shinjiro Ueda, Kashiwa; Yoshihiro Takada, Dejimamura; Hideo Nishida, Shimoinayoshi, all of Japan

[73] Assignee: Hitachi, Ltd., Tokyo, Japan

[21] Appl. No.: 232,007

[22] Filed: Feb. 6, 1981

[30] Foreign Application Priority Data

Feb. 8, 1980 [JP] Japan ..... 55-13718

[51] Int. Cl.[3] ..... F04D 29/30

[52] U.S. Cl. ..... 415/211; 415/216

[58] Field of Search ..... 415/207, 210, 211, 206, 415/209, 216

[56] References Cited

U.S. PATENT DOCUMENTS

| | | | |
|---|---|---|---|
| 3,692,426 | 9/1972 | Ryall et al. | 415/206 UX |
| 3,936,225 | 2/1976 | Stjerstrom | 415/207 |

FOREIGN PATENT DOCUMENTS

| | | | |
|---|---|---|---|
| 1937395 | 2/1971 | Fed. Rep. of Germany . | |
| 36-6326 | 5/1961 | Japan . | |
| 419639 | 4/1972 | U.S.S.R. | 415/211 |
| 522343 | 1/1974 | U.S.S.R. | 415/211 |
| 526721 | 3/1975 | U.S.S.R. | 415/211 |
| 572586 | 2/1976 | U.S.S.R. | 415/207 |

*Primary Examiner*—Philip R. Coe
*Assistant Examiner*—Joseh M. Pitko
*Attorney, Agent, or Firm*—Antonelli, Terry & Wands

[57] ABSTRACT

A vaneless diffuser disposed on the outer periphery of an impeller of a centrifugal compressor and including a pair of opposed diffuser plates of a disk shape defining therebetween a fluid channel is formed with a plurality of guide vanes extending from the inlet of the diffuser to its outlet. The guide vanes which are disposed on at least one of the pair of diffuser plates and extend immediately from the outlet of the impeller in the direction of flow of a fluid through the fluid channel has a height smaller than one-half the width of the fluid channel and gradually decreasing in going from the inlet of the diffuser toward its outlet.

16 Claims, 9 Drawing Figures

DIFFUSER OF CENTRIFUGAL FLUID MACHINE

BACKGROUND OF THE INVENTION

This invention relates to diffusers of centrifugal fluid machines, and more particularly it is concerned with a diffuser of a centrifugal fluid machine, specifically centrifugal compressor, capable of achieving a wide operation range and increased operation efficiency.

A vaneless diffuser used with a centrifugal compressor of the prior art comprises a pair of diffuser plates (disks) defining therebetween a fluid channel. A flow of fluid of high velocity issuing from the impeller has its energy of velocity converted to energy of pressure at the diffuser, to be collected and discharged through the outlet port after continuously recovering pressure in the scroll casing disposed downstream of the diffuser plates. Particularly in an impeller of high specific velocity which handles a fluid flowing in high flow rate, the flow angle $\alpha_2$ and the radial component $C_{2m}$ of the absolute velocity of the fluid at the outlet of the impeller have generally tended to show a markedly non-uniform (distorted) distribution from the shroud toward the hub as shown in FIGS. 1 and 2, because of the relatively large width of the outlet of the impeller. A distortion in the fluid flow at the inlet of the diffuser causes a marked reduction in the performance of the difuser as shown in FIG. 3 which shows the results of tests conducted on a two-dimensional diffuser in which Cp represents the ratio of the recovery of static pressure to the dynamic pressure at the diffuser inlet, and Bf represents the quantity (1—the ratio of fluid channel effective cross-sectional area to the geometrical cross-sectional area of fluid channel). The subscript ref indicates a reference value. The same results as shown in FIG. 3 could be obtained in tests on a radial type diffuser used in a centrifugal fluid machine.

As set forth hereinabove, the diffuser of a centrifugal compressor of the prior art has had nonuniformity in the flow of a fluid immediately after the fluid clears the impeller, thereby causing a marked reduction in performance. To obviate this disadvantage, we have made a proposal to provide, on at least one of the diffuser plates at the inlet portion of the diffuser, a plurality of flow guide vanes arranged in the form of a circular cascade and each having a height that does not exceed one-half the width of the fluid channel, as disclosed in U.S. Ser. No. 171,268, filed July 22, 1980.

This proposal has proved to have effect in rendering uniform the flow of the fluid clearing the impeller at the inlet of the diffuser. However, the proposed flow guide vanes have been found to have no effect in avoiding the occurrence of secondary flow in the lower portion of the vaneless diffuser. The reason is that in a flow of a viscous fluid, even if the fluid is caused to flow in a uniform pattern in the inlet portion of the diffuser, secondary flow is induced to occur in the outlet portion of the diffuser disposed on the downstream side because of the presence of the boundary layer which develops therein after being formed in the inlet portion.

SUMMARY OF THE INVENTION

An object of this invention is to provide a diffuser of a centrifugal fluid machine capable of rendering uniform the flow of the main stream in the inlet portion of the vaneless diffuser and avoiding the occurrence of secondary flow which might otherwise be induced by a boundary layer formed in the vicinity of the diffuser wall positioned against the main flow of the fluid.

Another object is to provide a diffuser of a centrifugal fluid machine provided with means for accomplishing the first object with increased efficiency.

Still another object is to provide a diffuser of a centrifugal fluid machine in which the surging region of the centrifugal compressor is shifted to a lower flow rate side.

To accomplish the aforesaid objects, the invention provides a plurality of guide vanes at least on one of the diffuser plates of a vaneless diffuser in the inlet portion thereof or immediately following the outlet of the impeller, each of the guide vanes having a height smaller than one-half the width of the fluid channel in the diffuser, to guide the fluid of low flow angle to thereby render the flow of all the fluid substantially uniform. Alternatively, guide grooves may be formed instead of the guide vanes. The height of the guide vanes and the depth of the guide grooves are increasingly reduced in going from the inlet of the diffuser toward the outlet thereof.

The reason why the height of the guide vanes is smaller than one-half the width of the fluid channel of the diffuser is that, as seen in FIG. 2, substantially no influences are exerted on the main stream in the central portion of the diffuser between the hub and the shroud. The reason why the height of the guide vanes is increasingly reduced in going from the inlet of the diffuser toward the outlet thereof is that, after the flow of the main stream is rendered uniform, a secondary flow loss can be avoided by minimizing the fluid friction loss by this arrangement.

DESCRIPTION OF THE PREFERRED EMBODIMENTS

Figure 4:
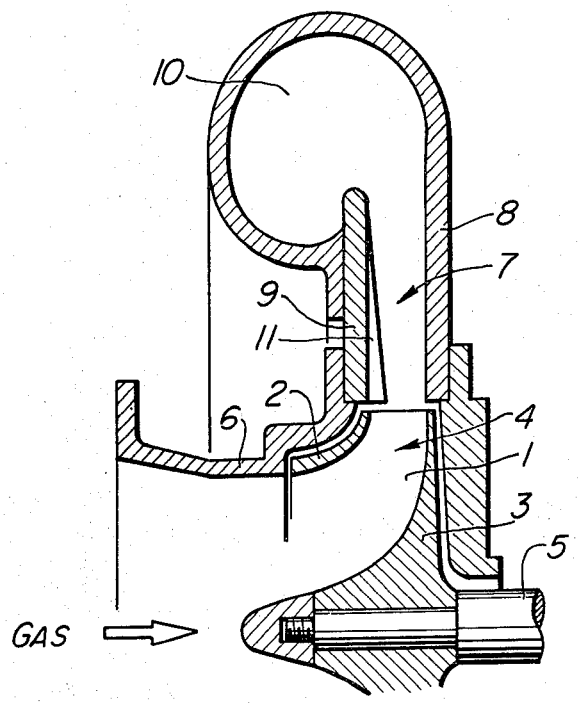
FIG. 4 is a vertical sectional view of the centrifugal fluid machine (centrifugal compressor) comprising one embodiment of the invention.
Figure 5:
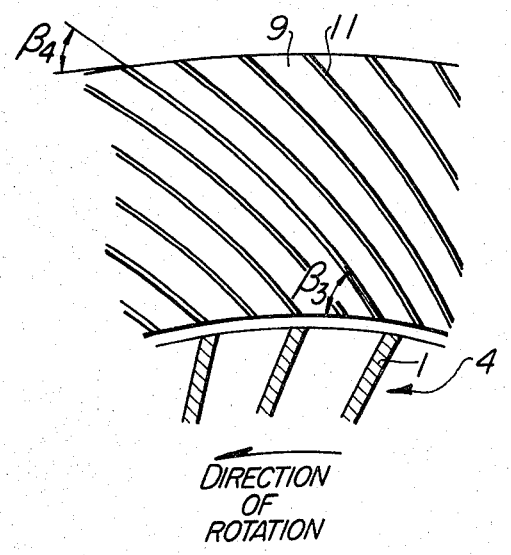
FIG. 5 is a front view of the guide vanes shown in FIG. 4.

FIG. 4 is a vertical sectional view of the centrifugal fluid machine (centrifugal compressor) comprising one embodiment of the invention, in which an impeller 4 including blades 1, a shroud 2 and a hub 3 is rotated by a rotary shaft 5. A gas is introduced into the centrifugal compressor through a suction duct 6, and converted into a stream of high velocity by the impeller 4 before being led to a diffuser 7. The diffuser 7 includes a pair of opposed diffuser plates (disks) 8 and 9 defining therebetween a fluid channel communicating with a scroll casing 10. A plurality of guide vanes 11 are provided on the diffuser plate 9 on the side of the shroud 2 and arranged peripherally of the diffuser plate 9 as shown in FIG. 5. Based on the design flow angle (a mean value of $\alpha_2$ shown in FIG. 2 widthwise of the diffuser), the guide vanes 11 are shaped as follows.

Figure 1:
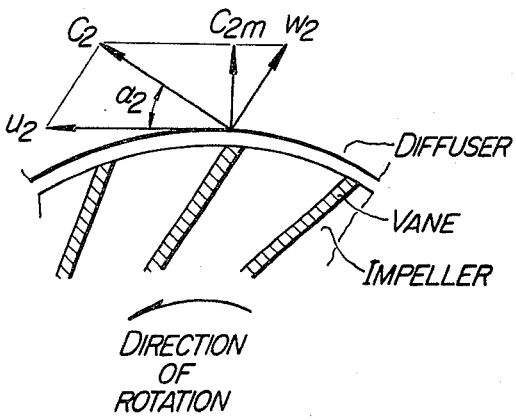
FIG. 1 PRIOR ART
FIG. 1 is a view in explanation (front view) of the flow of the fluid at the outlet of the impeller of a centrifugal fluid machine (centrifugal compressor) of the prior art.
Figure 2:
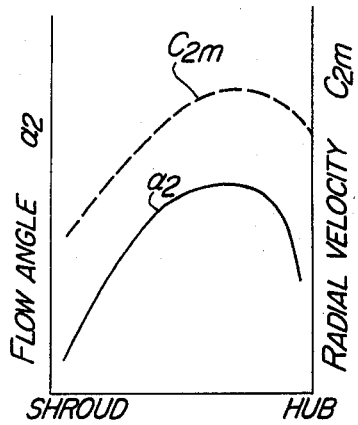
FIG. 2 PRIOR ART
FIG. 2 is a diagrammatic representation of the distribution of the flow of the fluid at the outlet of the impeller of a fluid machine (centrifugal compressor) of the prior art.
Figure 3:
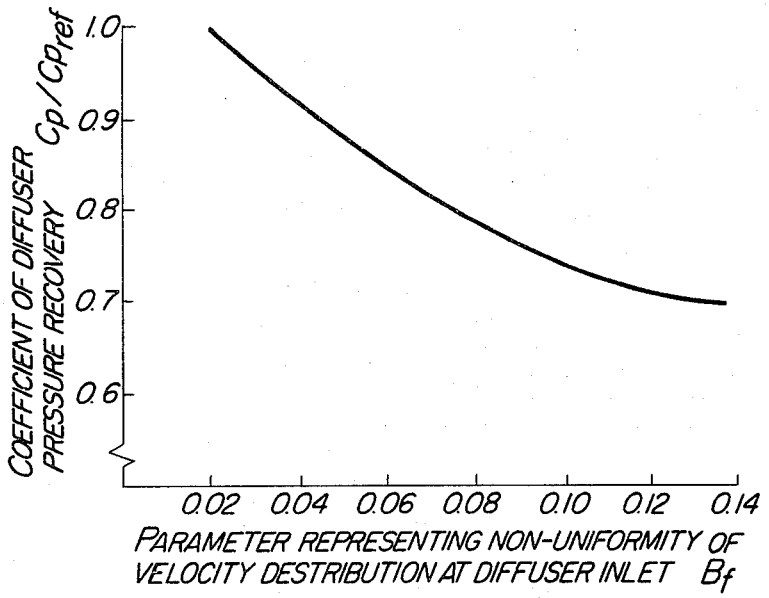
FIG. 3 PRIOR ART
FIG. 3 is a diagrammatic representation of the influences of the non-uniformity of the inlet velocity distribution exerted on the performance of a two-dimensional diffuser (results of experiments)

The guide vanes 11 each have an inlet angle $\beta_3$ which is equal to or smaller than the design flow angle (a mean value of $\alpha_2$ shown in FIG. 2 widthwise of the diffuser) and an outlet angle $\beta_4$ which is substantially equal to the design flow angle. The reasons for setting the inlet and outlet angles of the guide vanes 11 as set forth hereinabove are as follows. In the inlet portion of the diffuser 7, the flow angle $\alpha_2$ is smaller than the design flow angle at all times in a portion of the fluid channel near the shroud or the hub, as shown in FIG. 2. Thus, the above value is selected to cause the inlet angle $\beta_3$ of the guide vanes 11 to become close to the actual flow angle on an average, to minimize loss. With regard to the outlet angle $\beta_4$, the indicated angle is selected to cause the intermediate portion and the outlet portion of the guide vanes 11 to approximate an ideal flow in the diffuser (a flow a logarithmic spiral or a constant flow at a flow angle equal to the design flow angle). The guide vanes 11 are each formed of parabolic or other curves in the intermediate portion so that the angle may shift smoothly from $\beta_3$ to $\beta_4$. The guide vanes 11 each have a height which is smaller than one-half the width of the fluid channel defined between the diffuser plates 8 and 9. The height of the guide vanes 11 has a maximum value at the inlet of the diffuser 7 and is increasingly reduced in going from the inlet of the diffuser 7 toward the outlet thereof, until it is zero or $\frac{1}{4}$–$\frac{1}{2}$ the height at the inlet at the outlet of the diffuser 7.

The guide vanes 11 are intended to forcedly bring the distorted flow at the outlet of the impeller 4 or at the inlet of the diffuser 7 to a substantially uniform flow pattern to increase the efficiency of the vaneless diffuser and to inhibit the development of a boundary layer on the downstream side to avoid a loss of pressure which might otherwise occur due to the generation of secondary flow. The reduction in the height of the guide vanes on the downstream side is intended to reduce the surface area of the fluid channel in contact with the fluid to avoid a secondary flow loss on the downstream side while minimizing a fluid friction loss, because the flow is positively rendered uniform on the upstream side.

It has hitherto been considered undesirable to mount guide vanes, etc., in the diffuser in a position immediately following the inlet portion because of the possibilities of developing noise. However, it has been ascertained that the guide vanes according to the invention suffer no such disadvantages and have the effect of smoothly guiding the flow of the fluid, due probably to the fact that the guide vanes are not disposed along the entire width of the diffuser.

According to the invention, the provision of the guide vanes mounted on one of the diffuser plates and disposed in the fluid channel, with their height being great at the inlet and becoming increasingly smaller in going toward the outlet, in the diffuser has the effects of bringing the distorted flow of the fluid at the outlet of the impeller to a substantially uniform flow condition in the inlet portion of the diffuser, and of avoiding the generation of secondary flow with little fluid friction loss by the action of the guide vanes of reduced height in the outlet portion thereof, so as to thereby prevent the occurrence of an unstable operation phenomenon of the vaneless diffuser due to separation of the flow of the fluid from the surfaces of the diffuser plates and the back-flow of the fluid.

In this way, a characteristic of the compressor on the low flow rate side can be greatly improved. More specifically, the advantages offered by the invention stems from prevention of the occurrence of secondary flow. Assume that secondary flow occurs. Then a back-flow of the fluid toward the impeller from the diffuser would occur, and stall or other phenomenons of unstable flow of the fluid would take place, causing a surge to occur. In the invention, the occurrence of secondary flow within the diffuser can be avoided, so that the surge point of a centrifugal compressor can be shifted to a low flow rate side.

According to the invention, the provision of the guide vanes also has the effect of enabling a uniform flow of the fluid to be obtained in a vaneless diffuser, so that the peformance of the vaneless diffuser can be improved and the centrifugal compressor provided with such vaneless diffuser can have its performance markedly improved.

Figure 6:
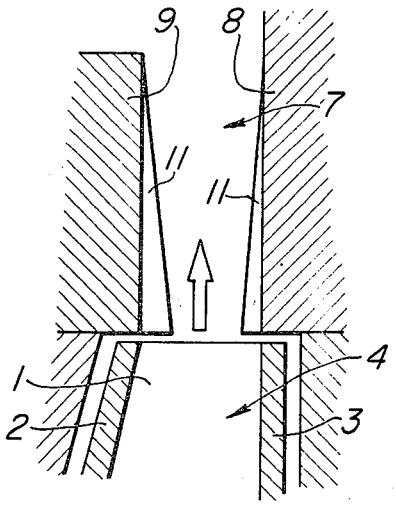
FIG. 6 is a vertical sectional view of the essential portions of the centrifugal compressor comprising another embodiment of the invention.
Figure 7:
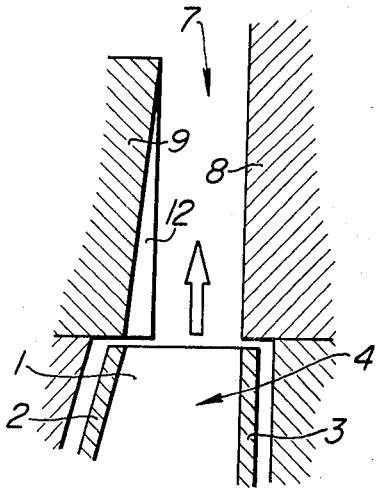
FIGS. 7A, 7B are vertical sectional views of the essential portions of the centrifugal compressor comprising still other embodiments of the invention.

Fig. 6 shows another embodiment in which the guide vanes 11 are mounted not only on the diffuser plate 9 on the side of the shroud 2 but also on the diffuser plate 8 on the side of the hub 3. The guide vanes 11 on the diffuser plate 8 cooperate with the guide vanes 11 on the diffuser plate 9 in guiding the flow of the fluid of low flow angle on the side of the hub 3 to bring the flow to a substantially uniform flow condition. Generally, the low flow angle region is small on the hub side, so that the height of the guide vanes 11 on the hub 3 side may be lower than that of the guide vanes 11 on the shroud 2 side.

Figure 7A:
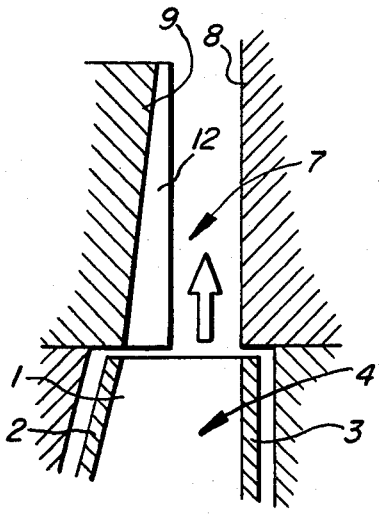
Figure 7B:
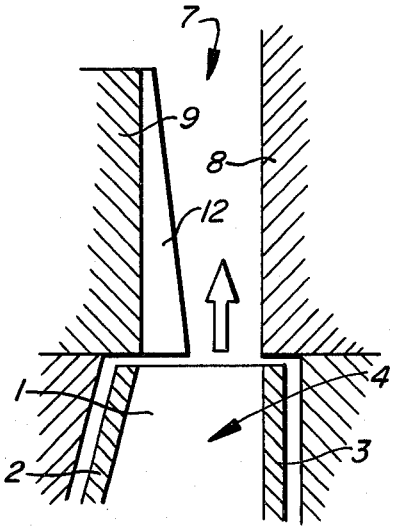

FIGS. 7A, 7B show still other embodiments in which a plurality of guide grooves 12 are formed on the diffuser plate 9 on the shroud 2 side, based on the same concept as the guide vanes 11 shown in FIG. 4. The guide grooves 12 which are disposed in the fluid channel defined by the diffuser plate 9 have a depth substantially equal to the height of the guide vanes 11 shown in FIG. 4. In this case, a portion of the fluid flowing in the guide grooves 12 pulls the rest of the fluid flowing on the diffuser plate 9, so that the flow of the fluid in the fluid channel can be brought to a substantially uniform flow condition. Thus the embodiments shown in FIGS. 7A, 7B can achieve the same effects as the embodiments shown in FIGS. 4 and 6. Portions of the diffuser plate 9 left over after the guide grooves 12 are formed are perferably as thin as possible. This is because the diffuser plate 9 of smaller thickness increases the force of the fluid flowing in the guide grooves that pulls the fluid flow in the fluid channel.

Figure 8:
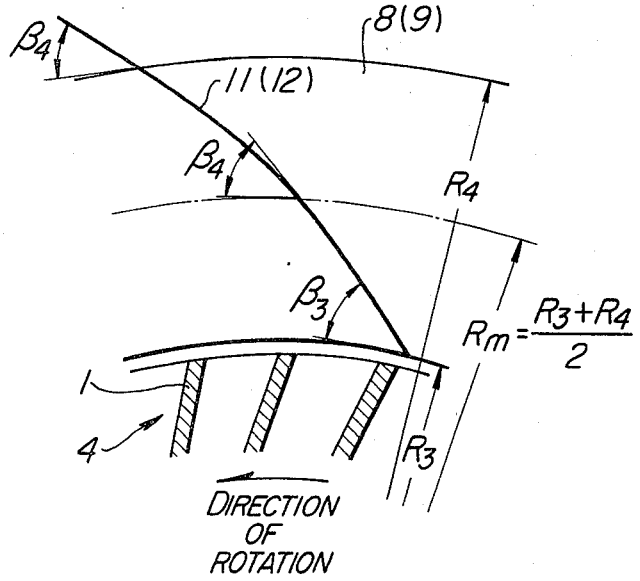
FIG. 8 is a front view of the diffuser showing the shape of the guide vanes (guide grooves).

FIG. 8 is a view in explanation of the process for determining the shape of the guide vanes 11 and guide grooves 12. The figure shows a concrete example in which the inlet and the outlet angles $\beta_3$ and $\beta_4$ of the guide vane meet the requirement $\beta_4 > \beta_3$, and the opposite end portions of the groove are smoothly connected together in the intermediate portion. More specifically, in the illustrated example, the vane angle in a position of a mean value Rm of the inlet radius R3 and outlet radius R4 of the diffuser is made equal to the outlet angle $\beta_4$ and the vane angle in positions outside the mean radius is kept constant ($\beta_4$), so that the guide vane is in a logarithmic spiral form. In positions inside the mean radius, a suitable curve, such as a parabola, an arc, etc., may be used.

What is claimed is:

1. A diffuser of a centrifugal fluid machine having an inlet and an outlet and comprising a pair of opposed diffuser plates, and a fluid channel defined between said pair of opposed diffuser plates, such diffuser being characterized by further comprising a plurality of guide vanes formed on at least one of said diffuser plates extending along the flow of a fluid in said fluid channel, said guide vanes each having a height smaller than one-half the width of said fluid channel and gradually decreasing in going from the inlet of the diffuser toward the outlet thereof, whereby a distorted flow at the inlet of the diffuser will be brought into a substantially uniform flow pattern in an inlet portion of the diffuser and generation of secondary flow in an outlet portion of the diffuser will be avoided, by said guide vanes.

2. A diffuser of a centrifugal fluid machine having an inlet and an outlet and comprising a pair of opposed diffuser plates, and a fluid channel defined between said pair of diffuser plates, such diffuser being characterized by further comprising a plurality of guide grooves formed on at least one of said diffuser plates and extending along the flow of a fluid in said fluid channel, said guide grooves having a depth smaller than one-half the width of said fluid channel and gradually decreasing in going from the inlet of the diffuser toward the outlet thereof, whereby a distorted flow at the inlet of the diffuser will be brought into a substantially uniform flow pattern in an inlet portion of the diffuser and generation of secondary flow in an outlet portion of the diffuser will be avoided, by said guide vanes.

3. A diffuser of a centrifugal fluid machine as set forth in claim 1 or 2, wherein said guide vanes or guide grooves are located only on the diffuser plate on the side of a shroud.

4. A diffuser of a centrifugal fluid machine as set forth in claim 3, wherein said guide vanes or guide grooves are mounted such that their inlet angle is equal to or smaller than the design flow angle and that their outlet angle are substantially equal to the design flow angle.

5. A diffuser of a centrifugal fluid machine as set forth in claim 1 or 2, wherein said guide vanes or guide grooves are located on both of said pair of opposed diffuser plates.

6. A diffuser of a centrifugal fluid machine as set forth in claim 5, wherein the height of the guide vanes or the depth of the guide grooves is smaller on the diffuser plate on the side of the hub than on the diffuser plate on the side of the shroud.

7. A diffuser of a centrifugal fluid machine as set forth in claim 6, wherein said guide vanes or guide grooves are mounted such that their inlet angle is equal to or smaller than the design flow angle and that their outlet angle are substantially equal to the design flow angle.

8. A diffuser of a centrifugal fluid machine as set forth in claim 5, wherein said guide vanes or guide grooves are mounted such that their inlet angle is equal to or smaller than the design flow angle and that their outlet angle are substantially equal to the design flow angle.

9. A diffuser of a centrifugal fluid machine as set forth in claim 1 or 2, wherein said guide vanes or guide grooves are mounted such that their inlet angle is equal to or smaller than the design flow angle and that their outlet angle are substantially equal to the design flow angle.

10. A diffuser of a centrifugal fluid machine according to claim 1 or 2, wherein the height of the guide vanes or guide grooves decreases from a maximum value at said inlet to a minimum value at the outlet of the diffuser.

11. A diffuser of a centrifugal fluid machine according to claim 10, wherein said minimum valve is substantially zero.

12. A diffuser of a centrifugal fluid machine according to claim 10, wherein said minimum value is $\frac{1}{4}$ to $\frac{1}{2}$ said maximum value.

13. A diffuser of a centrifugal machine as set forth in claim 1 or 2, wherein a maximum width of said fluid channel at said inlet of the diffuser is at least equal to a maximum width of said fluid channel at the diffuser outlet.

14. A diffuser of a centrifugal machine as set forth in claim 13, wherein the maximum width of the fluid channel remains constant throughout the length thereof.

15. A diffuser of a centrifugal machine as set forth in claim 13, wherein the maximum width of said fluid channel decreases throughout the length thereof.

16. A diffuser of a centrifugal machine as set forth in claim 15, wherein the maximum width of the fluid channel at said outlet of the diffuser is equal to a minimum width of the diffuser at the inlet thereof.

* * * * *